US008133324B2

(12) United States Patent
Claar et al.

(10) Patent No.: US 8,133,324 B2
(45) Date of Patent: Mar. 13, 2012

(54) METHODS FOR REMOVAL OF POLYMERIC COATING LAYERS FROM COATED SUBSTRATES

(75) Inventors: James A. Claar, Apollo, PA (US); Jerome J. Cuomo, Cary, NC (US); David A. Diehl, Pittsburgh, PA (US); Christopher J. Oldham, Raleigh, NC (US); Roger C. Sanwald, Raleigh, NC (US); Truman F. Wilt, Clinton, PA (US); Peter J. Yancey, Raleigh, NC (US)

(73) Assignee: PPG Industries Ohio, Inc, Cleveland, OH (US)

( * ) Notice: Subject to any disclaimer, the term of this patent is extended or adjusted under 35 U.S.C. 154(b) by 1786 days.

(21) Appl. No.: 11/154,924

(22) Filed: Jun. 16, 2005

(65) Prior Publication Data

US 2006/0000488 A1 Jan. 5, 2006

Related U.S. Application Data

(60) Provisional application No. 60/580,148, filed on Jun. 16, 2004.

(51) Int. Cl.
*B08B 7/00* (2006.01)

(52) U.S. Cl. ..... 134/1.1; 134/1.3; 134/38

(58) Field of Classification Search ..... 134/1, 1.1, 134/38; 156/345.1, 345.48; 313/231.01, 313/231.31, 231.71

See application file for complete search history.

(56) References Cited

U.S. PATENT DOCUMENTS

| | | | | |
|---|---|---|---|---|
| 5,328,517 | A * | 7/1994 | Cates et al. | 134/7 |
| 5,387,842 | A | 2/1995 | Roth et al. | 315/111.21 |
| 5,403,453 | A * | 4/1995 | Roth et al. | 204/164 |
| 5,414,324 | A * | 5/1995 | Roth et al. | 315/111.21 |
| 5,849,135 | A | 12/1998 | Selwyn | 156/345 |
| 5,961,772 | A * | 10/1999 | Selwyn | 156/345.39 |
| 5,970,993 | A * | 10/1999 | Witherspoon et al. | 134/1.1 |
| 6,042,929 | A * | 3/2000 | Burke et al. | 428/141 |
| 6,194,036 | B1 | 2/2001 | Babayan et al. | 427/563 |
| 6,228,330 | B1 | 5/2001 | Herrmann et al. | 422/186.05 |
| 6,262,523 | B1 | 7/2001 | Selwyn et al. | 313/231.31 |
| 6,490,994 | B1 * | 12/2002 | Yoshizawa | 118/723 ER |
| 6,546,938 | B2 | 4/2003 | Selwyn et al. | 134/1.2 |
| 6,805,139 | B1 * | 10/2004 | Savas et al. | 134/1.3 |
| 2003/0063942 | A1 * | 4/2003 | Gardner et al. | 401/16 |
| 2003/0213561 | A1 | 11/2003 | Selwyn et al. | 156/345.43 |
| 2005/0199340 | A1 | 9/2005 | Selwyn et al. | 156/345.1 |

FOREIGN PATENT DOCUMENTS

| | | |
|---|---|---|
| EP | 1410852 | 4/2004 |
| EP | 1410852 A1 * | 4/2004 |
| EP | 1410852 B1 | 4/2004 |
| WO | 99/20809 | 4/1999 |
| WO | 03/046970 | 6/2003 |

OTHER PUBLICATIONS

Felder et al., Elementary Principles of Chemical Processes, 2000, John Wiley & SOns, 3rd Edition, p. 51.*
Suchentrunk et al., Plasma surface engineering, 1999, Elsevier, 112, pp. 351-357.*
Paquin, The Gas Plasma Alternative to Wet Cleaning, 1994, pp. 1-5.*
English Translation of Claims for EP1410852.*
English Translation of Description for EP1410852.*
Plasma Sources Sci. Technol. 7, 1998, pp. 286-288, S. E. Babayan et al, "Deposition of silicon dioxide films with an atmospheric-pressure plasma jet".
Electronic Address: Olivier.Goossen@vito.be, 5 pages, O. Goossens et al, "Physical and chemical properties of atmospheric pressure plasma polymer films".
New Diamond and Frontier Carbon Technology, vol. 13, No. 4, 2003, pp. 175-189, C.-P. Klages et al, "Atmospheric pressure PA-CVD of silicon- and carbon-based coatings using dielectric barrier discharges".
Thin Films (Film Formation Techniques), vol. 23, pp. 1040-1076, "Thermographic Dyes, Thiazole Dyes, Thin Films, Film Formation Techniques".
Surface Engineering: Science and Technology I, edited by A. Kumar et al, The Minerals, Metals & Materials Society, 1999, pp. 99-103, A. T. Hunt, "Combustion chemical vapor deposition: a low-cost, open atmosphere process for the disposition of high-quality thin films".
J. Physical IV (1999), 9(Pr8, Proceedings of the Twelfth European Conference on Chemical Vapour Deposition, vol. 1, pp. 117-132, C. R. Kleijn et al, "Some Recent Developments in Chemical Vapor Disposition Process and Equipment Modeling".
J. Res. Dev. (1995), volume date 1995, 39(4), pp. 837-864, D. R. Cote et al, "Low-Temperature Chemical Vapor Deposition Processes and Dielectrics for Microelectronic Circuit".
NATO ASI Ser., Ser. E (1992), 222(Crucial Issues in Semiconductor Materials and Processing Technologies, pp. 55-59, D. T. Grider et al, "Rapid Thermal Chemical Vapor Deposition of SixGel-x Alloys on Silicon and Silica and New Applications of SixGel-x".
Vak. Prax. 1992, 4(4), pp. 277-284, H. K. Pulker, "Cold Plasmas in Reactive Physical and Chemical Vapor Deposition Processes".
Thin Solid Films, 1985, 130(3-4) pp. 261-282, J. O. Carlsson, "Processes in Interfacial Zones During Chemical Vapor Deposition: Aspects of Kinetics, Mechanisms, Adhesion and Substrate Atom Transport".

* cited by examiner

*Primary Examiner* — Michael Kornakov
*Assistant Examiner* — Nicole Blan
(74) *Attorney, Agent, or Firm* — Deborah Altman

(57) ABSTRACT

The invention provides a method for the at least partial removal of one or more polymeric coating layers from a coated substrate having at least one coated surface. The method includes generating at least one reactive species in an ionized gas stream discharged at atmospheric pressure; and placing the coated surface in the ionized gas stream. The at least one reactive species reacts with the one or more polymeric coating layers such that one or more coating layers is at least partially removed from the coated surface of the substrate at atmospheric pressure.

20 Claims, No Drawings

METHODS FOR REMOVAL OF POLYMERIC COATING LAYERS FROM COATED SUBSTRATES

This application claims priority from provisional application 60/580,148, filed Jun. 16, 2004.

BACKGROUND OF THE INVENTION

Field of the Invention

The present invention relates generally to methods for the removal of polymeric coating layers, and particularly to the removal of polymeric coating layers from a coated substrate using an atmospheric pressure plasma discharge.

The term "plasma" generally describes a partially ionized gas composed of ions, electrons and neutral species. Plasma may be produced by the action of energy input, for example by chemical means, very high temperatures, strong constant electric fields, and particularly radio frequency (RF) electromagnetic fields.

Plasmas have been used extensively in a wide variety of industrial and high technology applications including, for example, semiconductor fabrication, various surface modifications, and coatings of reflective films for window panels and compact disks. Plasmas ranging in pressure from high vacuum (<0.1 mTorr) to several Torr are common and have been used for film deposition, reactive ion etching, sputtering and various other forms of surface modifications. For example, gas plasmas are known for the treatment of plastics and molded substrates (e.g., thermoplastic olefin substrates used as bumpers and fascia in the automotive industry) to improve adhesion of subsequently applied coating layers. The modification typically is a few molecular layers deep, thus bulk properties of the polymeric substrate are unaffected. A primary advantage of using plasma for such purposes is that it results in an "all dry" process that generates little or no effluent, does not require hazardous conditions such as high pressures, and is applicable to a variety of vacuum-compatible materials, including, inter alia, silicon, metals, glass and ceramics.

It is commonly known to use plasma, typically $O_2$ plasmas, as a means of removing hydrocarbon and other organic surface contaminants from various substrates. However, because of the short lifetime of these reactants and their line-of-sight reactivity on the surface, these highly activated reactants are not especially well-suited for surface cleaning of irregular surfaces, unpolished or roughened metallic surfaces, or surfaces having a three-dimensional topography.

Also, use of plasma at reduced pressures has several disadvantages in that the substrate to be treated or cleaned must be evacuated and must be capable of surviving under such reduced pressure conditions. Use of a plasma at or above atmospheric pressure avoids these drawbacks. One problem with conventional atmospheric pressure discharges has been the rapid recombination of atomic oxygen and $O_2$+ at this pressure. However, metastable oxygen (1 $\Delta g$ $O_2$), formed in a plasma has a lifetime ranging from 0.1 sec (at atmospheric pressure) to 45 min. (at zero pressure), and also has 1 eV of internal energy to promote its chemical reactivity. Metastable oxygen production in plasmas is increased at higher pressures. Use of metastables including metastable $O_2$ for cleaning surfaces is known, and permits plasma processing of both vacuum compatible and incompatible materials at reduced cost and complexity.

Atmospheric pressure plasma torches and flames typically rely on high-power DC or RF discharges and thermal ionization, and usually operate at high temperatures to produce substantial ionization. Consequently, these plasmas can destroy most substrate surfaces.

In the automotive refinish industry, often it is necessary to at least partially remove a portion of a coating layer or to remove one or more coating layers altogether from the vehicle body, for example in the area of collision damage, prior to application of the refinish coating(s) over the repair area. It may be necessary to remove just the clear coat layer of a color-plus-clear finish, or it may be necessary to remove both the color coat layer and the clear coat layer, or it may necessary to remove both, depending on the extent of the damage to the coating. Likewise, it may be necessary to remove all coating layers, including the topcoats, primer-surfacer, and/or electrocoat primer layers, to expose the substrate, which may be metallic or non-metallic. Similarly, coating layer removal may be necessary in the automotive assembly plant for "end of the line" repairs of the original equipment coatings. Conventionally, this coating layer removal is accomplished by sanding or abrading through the coating layer(s). As can be expected, it is quite difficult to control the amount of thickness of the one or more coating layers to be removed by sanding. Moreover, sanding processes are undesirable for the removal of coating layers from sensitive substrates. For example, in the event of "sanding through" all coating layers to substrate particularly an elastomeric, the substrate may be scratched or marred to an extent that the piece may need to be discarded, or at a minimum, may need to be re-coated with a primer-surfacer prior to subsequent application of a refinish or repair coating. Also, articles of manufacture, for example, an automobile body and its various coated parts and accessories in addition to the substantially flat horizontal and vertical surfaces (e.g. the hood, roof and major door surface), can have three-dimensional topographies or profiles (e.g., bumpers and fenders), which are not easily sanded uniformly.

In view of the foregoing, it would be desirable to provide a method, other than by sanding, for at least partially and selectively removing one or more polymeric coating layers from a variety of coated substrates, including those coated substrates having varying topographies and profiles.

SUMMARY OF THE INVENTION

In one embodiment, the present invention is directed to a method for at least partial removal of one or more polymeric coating layers from a coated substrate having at least one coated surface, the method comprising: generating at least one reactive species in an ionized gas stream discharged at atmospheric pressure; and placing the coated surface in the ionized gas stream, wherein the at least one reactive species reacts with the one or more polymeric coating layers such that one or more coating layers are at least partially removed from the coated surface of the substrate at atmospheric pressure.

Additionally, the present invention is directed to a method for the at least partial removal of one or more polymeric coating layers from a substrate having at least one coated surface, wherein at least one coated surface of the substrate is coated with a multi-layer composite coating comprising two or more polymeric coating layers.

DETAILED DESCRIPTION OF THE INVENTION

Other than in the operating examples, or where otherwise indicated, all numbers expressing quantities of ingredients, reaction conditions and so forth used in the specification and claims are to be understood as being modified in all instances by the term "about." Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

As previously mentioned, the present invention is directed to a method for the at least partial removal of one or more polymeric coating layers from a coated substrate having at least one coated surface. The method comprises the steps of generating at least one reactive species in an ionized gas stream discharged at atmospheric pressure; and placing the coated surface in the ionized gas stream. The at least one reactive species reacts with the one or more polymeric coating layers such that one or more coating layers is at least partially removed from the coated surface of the substrate at atmospheric pressure.

The method of the present invention can be used to remove one or more polymeric coating layers from virtually any substrate which can receive a polymeric coating, such as, for example, wood, metals, glass, cloth, plastic, fiberglass and fiberglass reinforced composites, foam, as well as elastomeric substrates and the like. In a particular embodiment, the methods of the present invention can be used to remove one or more polymeric coating layers from substrates that generally are suitable for use in the fabrication of manufactured articles.

In one embodiment of the present invention, the substrate can comprise a metallic substrate. Examples of suitable metallic substrates can include ferrous metals and non-ferrous metals. Suitable ferrous metals include iron, steel, and alloys thereof. Non-limiting examples of useful steel materials include cold-rolled steel, galvanized (zinc coated) steel, electrogalvanized steel, stainless steel, pickled steel, GALVANNEAL®, GALVALUME®, and GALVAN® zinc-aluminum alloys coated upon steel, and combinations thereof. Useful non-ferrous metals include aluminum, zinc, titanium, magnesium and alloys thereof. Combinations or composites of ferrous and non-ferrous metals, or combinations or composites of metals and non-metals also can be used. The substrates may be cleaned or uncleaned, and/or pretreated with any of the cleaner compositions and pretreatment compositions known in the art.

In another embodiment of the present invention, the substrate can comprise an elastomeric substrate. Suitable elastomeric substrates can include any of the thermoplastic or thermoset synthetic materials well known in the art, including fiber reinforced thermoset and thermoplastic materials. As used herein, by "thermosetting material" or "thermosetting composition" is meant one which "sets" irreversibly upon curing or crosslinking, wherein the polymer chains of the polymeric components are joined together by covalent bonds. This property is usually associated with a cross-linking reaction of the composition constituents often induced, for example, by heat or radiation. Hawley, Gessner G., The Condensed Chemical Dictionary, Ninth Edition., page 856; Surface Coatings, vol. 2, Oil and Colour Chemists' Association, Australia, TAFE Educational Books (1974). Once cured or crosslinked, a thermosetting material or composition will not melt upon the application of heat and is insoluble in solvents. By contrast, a "thermoplastic material" or "thermoplastic composition" comprises polymeric components which are not joined by covalent bonds and thereby can undergo liquid flow upon heating and are soluble in solvents. Saunders, K. J., Organic Polymer Chemistry, pp. 41-42, Chapman and Hall, London (1973).

Nonlimiting examples of suitable elastomeric substrate materials include polyethylene, polypropylene, thermoplastic polyolefin ("TPO"), reaction injected molded polyurethane ("RIM") and thermoplastic polyurethane ("TPU").

Nonlimiting examples of thermoset materials useful as substrates in connection with the present invention include polyesters, epoxides, phenolics, polyurethanes such as "RIM" thermoset materials, and mixtures of any of the foregoing. Nonlimiting examples of suitable thermoplastic materials include thermoplastic polyolefins such as polyethylene, polypropylene, polyamides such as nylon, thermoplastic polyurethanes, thermoplastic polyesters, acrylic polymers, vinyl polymers, polycarbonates, acrylonitrile-butadiene-styrene ("ABS") copolymers, ethylene propylene diene terpolymer ("EPDM") rubber, copolymers, and mixtures of any of the foregoing.

If desired, the polymeric substrates described above can have an adhesion promoter present on the surface of the substrate over which any of a number of coating compositions (including the coating compositions described below) can be applied. To facilitate adhesion of organic coatings to polymeric substrates, the substrate can be pretreated using an adhesion promoter layer or tie coat, e.g., a thin layer 0.25 mils (6.35 microns) thick, or by flame, corona, or atmospheric plasma pretreatment.

Suitable non-limiting examples of adhesion promoters for use over polymeric substrates include chlorinated polyolefin adhesion promoters, saturated polyhydroxylated polydiene polymers, and blends of the foregoing.

For purposes of the present invention, the terms "polymeric coating layer" and "polymeric layer" are intended to exclude layers of mill, lubricating, and/or machine oils, and oils from, for example, fingerprints, and the like. It should be understood that as used herein, a polymeric layer or composition formed "over" at least a portion of a "substrate" refers to a polymeric layer or composition formed directly on at least a portion of the substrate surface, as well as a polymeric layer or composition formed over any coating layer(s) or adhesion promoter material or pretreatment material which was previously applied to at least a portion of the substrate.

That is, the "substrate" upon which the first polymeric layer is formed can comprise a metallic or elastomeric substrate to which one or more coating layers have been previously applied. For example, the "substrate" can comprise a metallic substrate and a primer coating over at least a portion of the substrate surface, and the first polymeric layer can comprise an electrodepositable primer coating. Likewise, the "substrate" can comprise a metallic substrate (optionally, having been pretreated) having an electrodepositable primer formed over at least a portion thereof, and a primer-surfacer coating over at least a portion of the electrodepositable primer. The first polymeric layer can comprise, for example, a pigmented base coat over at least a portion of this multi-layer "substrate", and the second polymeric layer can comprise a substantially pigment-free top coat formed over at least a portion of the pigmented base coat.

As previously mentioned, the present invention is also directed to a method for the at least partial removal of one or more polymeric coating layers from a substrate having at least one coated surface, wherein at least one coated surface of the substrate is coated with a multi-layer composite coating. The multi-layer composite coating comprises two or more polymeric coating layers where one or more coating layers is formed over one or more previously applied coating layers. Such multi-layer composite coatings can comprise only two polymeric coating layers, wherein a first polymeric coating layer is formed on at least a portion of a substrate and a second polymeric coating layer is formed over at least a portion of the first polymeric coating layer. Alternatively, the multi-layer composite coating of the present invention can comprise a first polymeric coating layer over at least a portion of a substrate, and the second polymeric coating layer formed over at least a portion of the first polymeric layer, where there are one or more subsequent polymeric layers formed over at least a portion of the second polymeric layer, or where there have been one or more polymeric layers applied to the substrate prior to the application of the first polymeric coating layer.

For example, the first polymeric layer can comprise a primer-surfacer coating and the second polymeric layer can comprise a color-enhancing base coating to which has been subsequently applied a transparent top coat. Also, the first polymeric coating layer can comprise an electrodepositable primer coating layer and the second polymeric coating layer can comprise a primer-surfacer coating layer to which has been subsequently applied an appearance enhancing monocoat or a color-plus-clear coating system comprising a pigmented basecoat layer and a substantially pigment-free topcoat layer. Additionally, the first polymeric layer can comprise a transparent top coat (as the clear coat in a color-plus-clear coating system) and the second polymeric layer can comprise a repair top coat.

In an embodiment of the present invention, the coated substrate has a three-dimensional topography. When the substrates are used as components to fabricate articles of manufacture, such articles can have any shape and topography, and can be comprised of any of the substrates described above.

In the methods of the present invention, one or more polymeric coating layers are removed from the any of the coated substrates as described above by first generating at least one reactive species in an ionized gas stream (i.e., a plasma) discharged at atmospheric pressure, then placing the coated surface in the ionized gas stream. The reactive species react with the one or more polymeric coating layers to effectuate the at least partial removal of one or more coating layers. The reactive species can include, for example, photons, metastables, atomic species, free radicals, molecular fragments, monomers, electrons, and ions. Any of these species may be present in the ionized gas stream provided the reactive species are sufficiently chemically reactive to remove or ablate the coating layer(s) to be removed. For example an oxygen plasma can comprise O, $O_2^*$, and $O_3$. The method is carried out at atmospheric pressure, thus eliminating the need to evacuate the substrate as is required by many of the conventional plasma techniques which are carried out at reduced pressure conditions.

Any plasma source can be used in the methods of the present invention provided that the method can be conducted under atmospheric (ambient) pressure. One skilled in the art would understand that "atmospheric pressure" (or "ambient pressure") varies relative to sea level, and, therefore, will vary with geographic location. It should be understood that for purposes of the invention the particular temperature of the ionized gas stream at which the coating layers are removed will be selected based on the type(s) of polymeric coating(s) to be removed from the coated substrate, and, in some situations, the substrate itself.

Any suitable atmospheric plasma source can be employed in the methods of the present invention. Suitable plasma sources include, but are not limited to, the atmospheric-pressure plasma jets described in U.S. Pat. No. 5,961,772 at column 3, line 66 to column 7, line 10, and U.S. Pat. No. 6,262,523 B1 at column 4, line 29 to column 7, line 16; and the one atmosphere, uniform glow discharge plasma apparatus described in U.S. Pat. No. 5,414,324 at column 2, line 66 to column 5, line 28.

In a particular embodiment of the present invention, the at least one reactive species is generated in an ionized gas stream within an electromagnetic field. In further embodiments of the present invention, the reactive species can be generated in an ionized gas stream within, for example, a RF electromagnetic field, a DC electromagnetic field, a pulsed DC electromagnetic field, or an arbitrarily generated asymmetric pulsed electromagnetic field.

For purposes of the present invention, the plasma source can be hand-held during use, or can be used as a static "in-line" plasma source, or the plasma source can be movable by robotic or other mechanical means, for example, for removal of one or more coating layers from a coiled metal substrate on a coil line. Likewise, the method of the present invention can be used on a finished part, and is particularly suitable to remove coating layers from a coated substrate having a three-dimensional topography.

In the methods of the present invention, the at least one reactive species is generated in an ionized gas stream derived from a feed gas comprising any of a number of gases or combinations thereof. In an embodiment of the present invention, the ionized gas can be derived from a feed gas selected from helium, argon, neon, krypton, oxygen, carbon dioxide, nitrogen, hydrogen, methane, acetylene, propane, ammonia, and/or air.

In a further embodiment of the present invention, the feed gas comprises a mixture of helium and oxygen. In such a helium/oxygen gas mixture, the helium typically is present in the mixture in an amount ranging from 99.5 to 75 percent by volume, or 95 to 80 percent by volume, or 90 to 85 percent by volume; and the oxygen is present in the mixture in an amount ranging from 0.5 to 25 percent by volume, or 5 to 20 percent by volume, or 10 to 15 percent by volume, based on total volume of the mixture.

In a further embodiment of the present invention, the feed gas comprises a mixture of nitrogen and oxygen. In such a nitrogen/oxygen gas mixture, the nitrogen typically is present in the mixture in an amount ranging from 99.5 to 75 percent by volume, or 95 to 80 percent by volume, or 90 to 85 percent by volume; and the oxygen is present in the mixture in an amount ranging from 0.5 to 25 percent by volume, or 5 to 20 percent by volume, or 10 to 15 percent by volume, based on total volume of the mixture.

In a particular embodiment of the present invention, the at least one reactive species is generated in an ionized gas stream derived from ambient air, which may include water vapor and/or a variety of other gases.

It should be understood that for purposes of the invention the particular feed gas or mixture of feed gases, and the mixing ratio of these gases will be selected based on the types of polymeric coating(s) to be removed from the coated substrate, and, in some situations, the substrate itself.

In the method(s) of the present invention, effective feed gas flow rates can vary widely, for example, feed gas flow rates can range from 1 to 100 standard cubic feet per hour (scfh.), such as from 5 to 75 scfh., or 10 to 50 schf., or 10 to 35 schf. Also, by way of example, in the case where an atmospheric glow discharge plasma source is employed, it may not be necessary to use other than the gas flow induced by the conveyance of the coated substrate through the gap between plates, or the gas flow induced by negative pressure applied in the area where the treated substrate exits the ionized gas stream. Further, it has been found that the separation distance between the plasma source and the coated substrate surface can affect polymeric coating layer removal. Effective separation distances can vary, and typically can range, for example, between 0.1 to 50 millimeters, such as 0.1 to 35 millimeters, or 0.1 to 25 millimeters, or 1 to 10 millimeters. Likewise, effective power density (power per unit volume) for the plasma (i.e., the ionized gas stream) can range from 0.1 Watts/$cm^3$, such as from 0.5 to 150 Watts/$cm^3$. Further, it should be understood that dwell time (i.e., residence time of the coated substrate surface in the ionized gas stream) can range widely dependent upon the other method parameters, as well as the type of polymeric coating to be removed and the substrate itself. For example, a dwell time range of 0.01 to 1 second had been found to be effective in the layer-by-layer removal of a thermosetting polyurethane coating system from a fiberglass composite substrate.

It would be understood by skilled artisans that any of the previously mentioned parameters, e.g., separation distance, power density, feed gas flow rates, and dwell times, required to effect at least partial removal of a polymeric coating layer from a coated substrate may vary widely dependent upon what plasma source is employed. For example, an atmospheric glow discharge plasma source typically will generate a plasma which is much more diffuse than that generated by an atmospheric-pressure plasma torch-type plasma source. Hence, the former plasma source is likely to have a power density much lower than that of the latter. Likewise, the atmospheric glow discharge plasma source may require a longer dwell time to effect polymeric coating layer removal than that required using an atmospheric-pressure plasma torcht-type plasma source.

By judicious selection of the plasma source and/or related process parameters, such as power, feed gas(es), flow rate of the feed gas(es), temperature, dwell time, and the like, the methods of the present invention are particularly useful for the controlled and/or selective removal of one or more polymeric coating layers while maintaining the integrity of the coating layer(s) which had been applied prior to the layer removed, or the integrity of the substrate itself, or both. That is, for example, a partial layer of one coating layer (e.g., a monocoat layer or a clear top coat layer) may be removed by applying controlled removal parameters, or all of a top coat layer can be controllably and/or selectively removed, while the basecoat, that had been applied prior to the top coat, remains in tact. Likewise, the method can be carried out in such a manner that all top coats (e.g., a basecoat/clearcoat system, or a monocoat) can be removed leaving in tact the primer-surfacer coating which had been applied prior to the top coat which was removed. Moreover, all coating layers can be removed from a sensitive substrate without the use of aggressive solvents or sanding, thereby maintaining the integrity of the substrate.

The one or more coating layer(s) which are at least partially removed in the method of the present invention can have a total thickness ranging from 1 Angstrom to 10,000 microns, such as from 0.001 micron to 5,000 microns, or 0.001 micron to 1,000 microns, or 0.01 micron to 500 microns, or 0.1 micron to 250 microns. The thickness of the coating layer(s) can range between any of these values, inclusive of the recited values.

Further, it is anticipated that the effectiveness of the methods of the present invention can be enhanced through the use of coatings, applied as monocoats, or as one or more coating layers in a multi-layer composite coating, that are more susceptible to removal by particular reactive species, for example, polyester- and/or polyether-based coatings, as are well known in the art, which can be susceptible to oxygen ions or oxidation and/or reduction.

The one or more coating layers which can be removed by the methods of the present invention may be selected from electrodepositable film-forming compositions, primer compositions, pigmented or non-pigmented monocoat compositions, pigmented base coat compositions, transparent or substantially pigment-free topcoat compositions, and other coatings commonly used in the coating of substrates. The multi-layer composite coating is formed from combinations of at least two of the above-mentioned coating compositions. Non-limiting examples include an electrophoretically-applied composition followed by a spray-applied primer composition, or an electrophoretically-applied composition followed by a spray-applied primer composition and then a monocoat composition, or an electrophoretically-applied composition followed by a spray-applied primer composition and then a color-plus-clear composite coating. Alternatively, the first coating composition may be a single composition applied directly to a substrate that optionally has been pretreated, or to a substrate that has been coated previously with one or more protective and/or decorative coatings. The second coating composition may be applied directly over any of the compositions indicated above as the first coating composition.

The coating composition(s) can comprise any of a variety of thermoplastic and/or thermosetting compositions known in the art. The coating composition(s) may be water-based or solvent-based liquid compositions, or, alternatively, in solid particulate form, i.e., a powder coating.

The thermosetting coating compositions typically comprise a crosslinking agent that may be selected from, for example, aminoplasts, polyisocyanates including blocked isocyanates, polyepoxides, beta-hydroxyalkylamides, polyacids, an hydrides, organometallic acid-functional materials, polyamines, polyamides, and mixtures of any of the foregoing.

In addition to or in lieu of the above-described crosslinking agents, the coating composition typically comprises at least one film-forming resin. Thermosetting or curable coating compositions typically comprise film forming polymers having functional groups that are reactive with the crosslinking agent. The film-forming resin in the first coating composition may be selected from any of a variety of polymers well-known in the art. The film-forming resin can be selected from for example, acrylic polymers, polyester polymers, polyurethane polymers, polyamide polymers, polyether polymers, polysiloxane polymers, copolymers thereof, and mixtures thereof. Generally these polymers can be any polymers of these types made by any method known to those skilled in the art. Such polymers may be solvent borne or water dispersible, emulsifiable, or of limited water solubility. The functional groups on the film-forming resin may be selected from any of a variety of reactive functional groups including, for example, carboxylic acid groups, amine groups, epoxide groups, hydroxyl groups, thiol groups, carbamate groups, amide groups, urea groups, isocyanate groups (including blocked isocyanate groups) mercaptan groups, and combinations thereof.

Appropriate mixtures of film-forming resins may also be used in the preparation of the coating compositions.

If desired, the coating composition used to form any of the coating layers can comprise other optional materials well known in the art of formulated surface coatings, such as plasticizers, anti-oxidants, hindered amine light stabilizers, UV light absorbers and stabilizers, surfactants, flow control agents, thixotropic agents such as bentonite clay, pigments, fillers, organic cosolvents, catalysts, including phosphonic acids and other customary auxiliaries. These materials can constitute up to 40 percent by weight of the total weight of the coating composition.

To form a coating layer, a coating composition can be applied to the substrate by conventional means including electrodeposition, brushing, dipping, flow coating, spraying, roll coating, and the like. In the process of electrodeposition, the electroconductive substrate being coated, serving as an electrode, and an electrically conductive counter electrode are placed in contact with an ionic, electrodepositable composition. Upon passage of an electric current between the electrode and counter electrode while they are in contact with the electrodepositable composition, an adherent film of the electrodepositable composition will deposit in a substantially continuous manner on the metal substrate.

After application of the coating layer to the substrate, a film is formed on the surface of the substrate, usually by driving water and/or organic solvents out of the film (flashing) by heating or by an air-drying period. If more than one coating composition is applied to the substrate, flashing or, optionally curing may be done after the application of each coating layer.

The coated substrate may be heated to at least partially cure the coating layer. In the curing operation, solvents are driven off and the film-forming materials are crosslinked. The heating or curing operation can be carried out at ambient temperature or, alternative at a temperature in the range of from 160-350° F. (71-177° C.). If needed, lower or higher temperatures may be used as necessary to activate crosslinking mechanisms. Again, if more than one coating composition is to be applied to the substrate, curing may be done after the application of each coating layer, or curing of multiple layers simultaneously is possible. It should be mentioned that such coating composition(s) can be formulated as a one-component composition where a curing agent such as an aminoplast resin and/or a blocked isocyanate compound such as those described above is admixed with other composition components. The one-component composition can be storage stable as formulated. Alternatively, compositions can be formulated as a two-component composition where, for example, a polyisocyanate curing agent such as those described above can be added to a pre-formed admixture of the other composition components just prior to application. The pre-formed admixture also can comprise curing agents for example, aminoplast resins and/or blocked isocyanate compounds such as those described above.

As previously mentioned, the coating composition can be a thermoplastic composition. In such instances, the one or more film-forming polymers used in the coating composition(s) may or may not comprise reactive functional groups. Likewise, any additional polymers or adjuvant materials included in the thermoplastic coating compositions may or may not comprise reactive functional groups. Where appropriate, the coating compositions can further comprise one or more pigments (in addition to any of the above-described components). Nonlimiting examples of suitable metallic pigments include aluminum flake, copper bronze flake, and metal oxide coated mica. Besides the metallic pigments, the coating compositions also can contain nonmetallic color pigments conventionally used in surface coatings such as, for example, inorganic pigments such as titanium dioxide, iron oxide, chromium oxide, lead chromate, and carbon black; and organic pigments such as phthalocyanine blue and phthalocyanine green.

As would be understood by one skilled in the art, coating film thickness, and curing temperatures and conditions will depend upon the type of coating layer to be formed, i.e., an electrodeposition coating, a primer-surfacer coating, a basecoating, a monocoat; as well as the coating composition itself, i.e., whether thermosetting or thermoplastic, whether ambient or thermally curable, and, if thermosetting, the type of curing reaction required.Illustrating the invention are the following examples that are not to be considered as limiting the invention to their details.

EXAMPLES

Example A

This example describes the removal of a polyurethane coating system layer (primer and topcoat) from two aircraft substrates (i.e., fiberglass composite substrate and carbon fiber composite substrate) using an atmospheric plasma gun with the following parameters.

| | |
|---|---|
| Feed gas: | Ambient air |
| Gas flow rate: | 10 to 35 scfh. |
| Separation distance: | 3 to 10 millimeters |
| Power level: | 300 to 500 Watts |

For each coated substrate type, 1 inch by 1 inch plaques were cut. For each coated substrate sample, a plaque was affixed to a turntable above which the atmospheric plasma gun was mounted. The atmospheric plasma gun was positioned such that the plasma source was perpendicular to the approximate center of the plaque to be tested. The turntable was spun under the plasma (ionized gas stream) at a speed of 50 RPM's for a total of 8 rotations such that the plasma contacted the coated surface of the substrate (exposure width of 5 mm/exposure length of 25.4 mm). The coating was removed to expose the substrate (approximately 70 microns of total coating thickness). The area of coating removed per unit time was determined as follows. Measuring the radius of the spinning sample to be 2.5", a circumference of 15.71" was calculated. With a 1" treated length, the ratio of exposed/treated length to the entire circumference was 0.064. By taking the 8 rotations and dividing by 50 RPM's, the total treatment time was found to be 0.16 minutes. Multiplying the total treatment time by the ratio of the treated length to the circumference, the treatment time on the sample was calculated to be 0.01 minutes. With the understanding that if it took 0.01 minute to expose a 0.07 mm×5 mm×25.4 mm volume, then a calculation of the time to remove a 1 ft×1 ft sample was done. Using the 5 mm exposure width it was calculated that 5.08 bins are contained in a 25.4 mm sample. It was then determined that to remove a 1 square inch sample, it would take 0.01 minutes multiplied by 5.08 bins which equals 0.052 minutes. The time it took to remove a 1 inch×12 inch coating sample was calculated by multiplying 0.052 minutes×12 one inch bins, that is, 0.621 minutes. Finally 0.621 minutes was multiplied by another 12 one-inch bins to calculate the time to remove a 1 ft2 coating sample which is equal to 7.451 minutes, that is, 8.0 ft2/minute.

Example B

This example describes the calculation of the rate of removal of a coating by exposure to atmospheric plasma. An unpigmented aerospace polyurethane primer coating composition was spun onto silicon wafers. The coated silicon wafer surface was exposed to (treated with) the plasma (under the process parameters set forth above). Coated silicon wafer samples were affixed to the turntable as described above for coated substrate plaques. The turntable was spun at a speed of 60 RPM's for 10 rotations. A step height (height from exposed substrate surface to the untreated coating surface immediately adjacent to the area where coating had been removed by the plasma) of 3.69 microns was measured. By measuring the radius of the treated/exposed sample and treated/exposed length, a calculation of treated ratio to circumference of the rotation was found to be 0.33. This constituted a total exposure/treatment time of 0.055 minutes. The step height of 3.69 microns was divided by the treatment time of 0.055 minutes to determine a removal rate of 67 microns/minute.

Whereas particular embodiments of this invention have been described above for purposes of illustration, it will be evident to those skilled in the art that numerous variations of the details of the present invention may be made without departing from the scope of the invention as defined in the appended claims.

Therefore, we claim:

1. A method for the at least partial removal of one or more polymeric coating layers from a coated substrate having at least one coated surface, wherein the at least one coated surface of the substrate is coated with a multi-layer composite coating comprising two or more polymeric layers, the method comprising:

generating at least one reactive species in a continuous ionized gas stream at or near room temperature and discharged at atmospheric pressure; and placing the coated surface in the ionized gas stream, wherein the at least one reactive species reacts with at least one of the polymeric coating layers such that the at least one polymeric coating layer is at least partially removed from the coated surface of the substrate at atmospheric pressure.

2. The method of claim 1, wherein the at least one reactive species is generated in an ionized gas stream within an electromagnetic field.

3. The method of claim 1, wherein the at least one reactive species is generated in an ionized gas stream within a radio frequency electromagnetic field.

4. The method of claim 1, wherein the ionized gas stream comprises an ionized gas derived from a feed gas selected from helium, argon, neon, krypton, oxygen, carbon dioxide, nitrogen, hydrogen, methane, acetylene, propane, ammonia, and/or air.

5. The method of claim 4, wherein the feed gas comprises a mixture of nitrogen and oxygen.

6. The method of claim 5, wherein the nitrogen is present in the mixture in an amount ranging from 99.5 to 75 percent by volume, and oxygen is present in the mixture in an amount ranging from 0.5 to 25 percent by volume.

7. The method of claim 4, wherein the flow rate of the feed gas ranges from 1 to 100 standard cubic feet per hour (0.028316 to 2.8316 standard cubic meters per hour).

8. The method of claim 1, wherein the at least one polymeric coating layer removed from the at least one coated surface has a total thickness ranging from 1 Angstrom to 10,000 microns.

9. The method of claim 1, wherein the at least one polymeric coating layer removed from the at least one coated surface comprises at least a portion of a top coat layer in a multilayer composite coating.

10. The method of claim 1, wherein the at least one polymeric coating layer removed from the at least one coated surface comprises at least a portion of a base coat layer in a multilayer composite coating.

11. The method of claim 1, wherein the at least one polymeric coating layers removed from the at least one coated surface comprises at least a portion of a base coat layer and at least a portion of a top coat layer of a multilayer composite coating.

12. The method of claim 1, wherein the at least one polymeric coating layer removed from the at least one coated surface comprises at least a portion of a primer coating layer.

13. The method of claim 1, wherein the coated substrate comprises a coated automotive part.

14. The method of claim 1, wherein the coated substrate comprises a substrate comprising a metal substrate, an elastomeric substrate, a glass substrate, a fiberglass substrate, a wood substrate, composites thereof, and/or combinations thereof.

15. The method of claim 1, wherein the coated substrate comprises a ferrous metal substrate, a non-ferrous metal substrate, and/or a combination thereof.

16. The method of claim 1, wherein the coated substrate has a three-dimensional topography.

17. The method of claim 1, wherein the coated surface is in the ionized gas stream for a period of time ranging from 0.01 to 1 second.

18. The method of claim 1, wherein the at least one reactive species in an ionized gas stream having a power density ranging from 0.1 Watts per cubic centimeter to 200 Watts per cubic centimeter.

19. The method of claim 1, wherein the distance between the coated surface and the source of the ionized gas stream ranges from 0.1 to 50 millimeters.

20. The method of claim 1, wherein the coated substrate comprises a composite substrate.

* * * * *